United States Patent [19]

Spitzer et al.

[11] 4,019,657

[45] Apr. 26, 1977

[54] AEROSOL CONTAINERS FOR FOAMING AND DELIVERING AEROSOLS

[75] Inventors: Joseph George Spitzer, 44 Coconut Row, Palm Beach, Fla. 33480; Marvin Small, 1100 Park Ave., New York, N.Y. 10028; Lloyd I. Osipow, 2 Fifth Ave., New York, N.Y. 10003; Dorothea C. Marra, 107 Fernwood Road, Summit, N.J. 07901.

[22] Filed: Mar. 26, 1976

[21] Appl. No.: 670,913

Related U.S. Application Data

[63] Continuation-in-part of Ser. Nos. 554,388, March 3, 1975, Pat. No. 3,970,219, and Ser. No. 566,562, April 9, 1975, abandoned, and Ser. No. 620,448, Oct. 7, 1975, abandoned, and Ser. No. 628,283, Nov. 3, 1975, abandoned.

[52] U.S. Cl. ..... 222/136; 222/190; 222/193

[51] Int. Cl.[2] ..... B65D 83/14; B65D 83/00

[58] Field of Search ..... 222/129, 136, 190, 193, 222/402.24; 239/304, 308, 326, 343, 370

[56] References Cited

UNITED STATES PATENTS

| | | | |
|---|---|---|---|
| 3,069,098 | 12/1962 | Frangos et al. | 239/326 X |
| 3,134,518 | 5/1964 | Sagarin et al. | 222/187 X |
| 3,428,222 | 2/1969 | Wright | 222/190 X |
| 3,471,064 | 10/1969 | Micallef | 222/190 X |
| 3,615,042 | 10/1971 | Marand | 222/402.24 |

*Primary Examiner*—Robert B. Reeves
*Assistant Examiner*—David A. Scherbel

[57] ABSTRACT

An aerosol container is provided for foaming a liquid aerosol composition therein prior to expulsion from the container and then expelling the resulting foamed aerosol composition comprising at least two separate compartments in the container, of which a first compartment has a volume of at least 0.5 cc and is in direct flow connection with the valve passage, and a second compartment is in flow connection with the valve passage only via the first compartment; at least one first liquid tap orifice having a diameter within the range from about 0.012 to about 0.2 cm and communicating the first and another compartment for flow of liquid aerosol composition into the first compartment from the other compartment, and of sufficiently small dimensions to restrict flow of liquid aerosol composition therethrough; the ratio of first compartment volume/first orifice diameter being from about $10/x$ to about $400/x$, where $x$ is 1 when the orifice length is less than 1 cm, and 2 when the orifice length is 1 cm or more; at least one second gas tap orifice of sufficiently small dimensions to restrict flow of propellant gas and form bubbles of such gas in liquid aerosol composition across the line of flow thereof to the valve.

11 Claims, 4 Drawing Figures

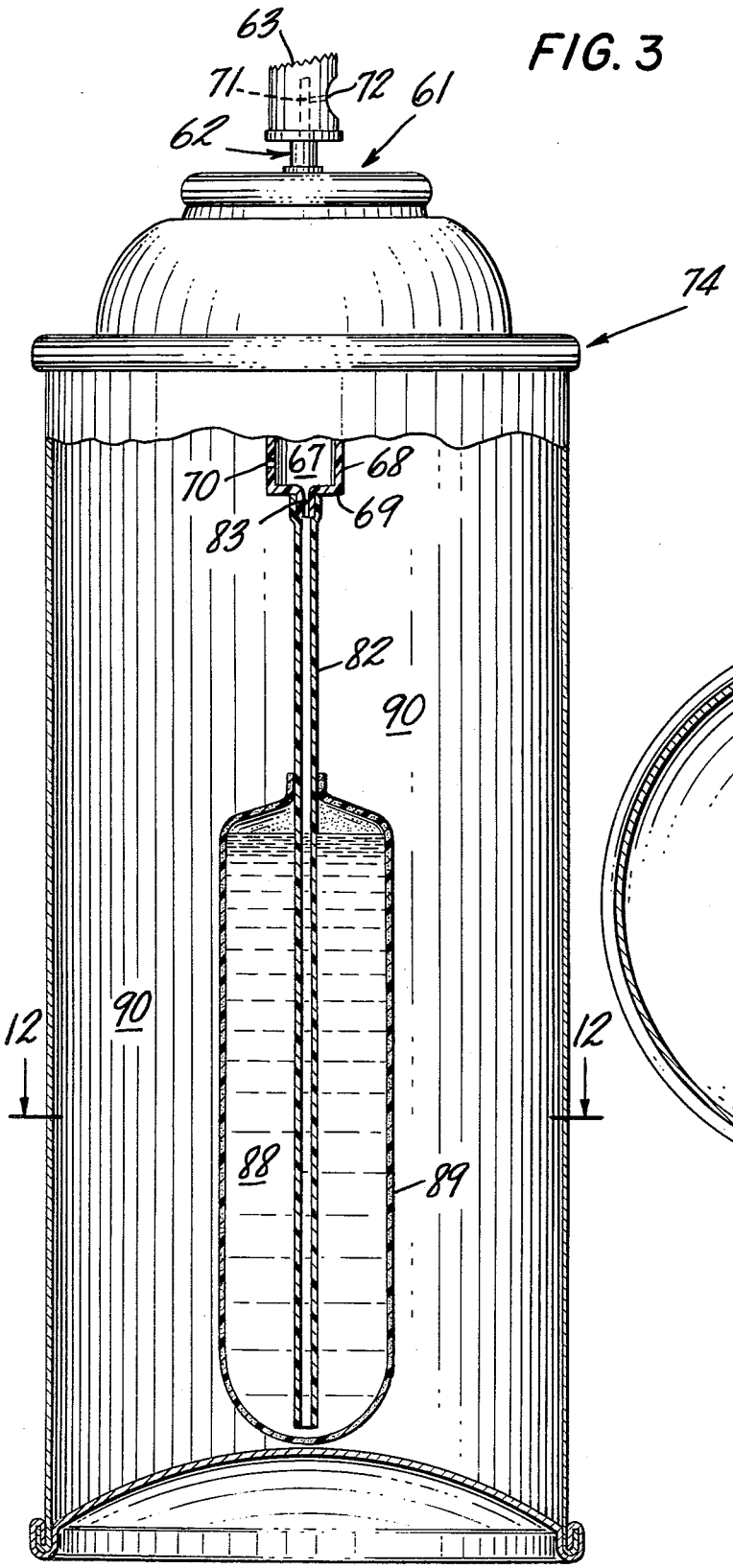
FIG. 3
FIG. 4
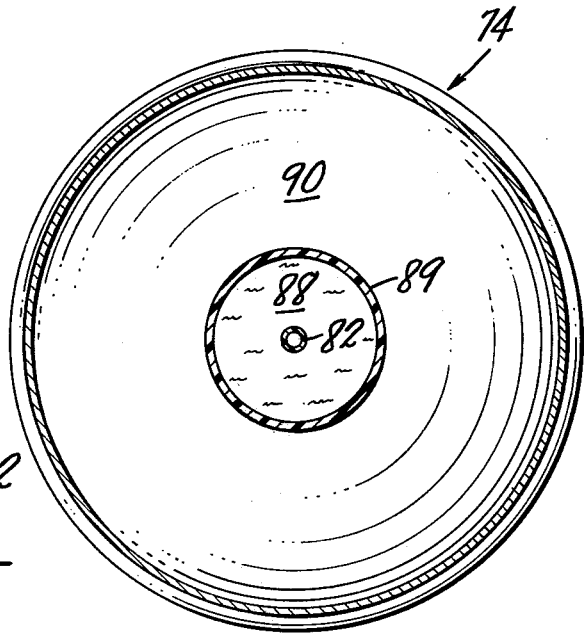

AEROSOL CONTAINERS FOR FOAMING AND DELIVERING AEROSOLS

This application is a continuation-in-part of Ser. No. 554,388, filed Mar. 3, 1975 now U.S. Pat. No. 3,970,219 issued July 20, 1976; and also a continuation-in-part of, Ser. No. 566,562, filed Apr. 9, 1975, of Ser. No. 620,448, filed Oct. 7, 1975, and of Ser. No. 628,283 filed Nov. 3, 1975, all now abandoned.

Aerosol sprays are now widely used, particularly in the cosmetic, topical pharmaceutical and detergent fields, for delivery of an additive such as a cosmetic, pharmaceutical or cleaning composition to a substrate such as the skin or other surface to be treated. Aerosol compositions are especially widely used as antiperspirants, to direct the antiperspirant to the skin in the form of a finely divided spray.

Conventional aerosol containers are designed to confine liquefied propellant gases under high pressure and to deliver a liquid spray from the delivery port of the valve. It is however a difficult design problem to deliver a spray with sufficiently fine droplets, susceptible of being so directed as to travel a considerable distance through the air, in the direction in which the delivery port of the valve is pointed.

The problem is especially difficult when the aerosol composition includes solid particles dispersed in a liquid vehicle, as in the case of antiperspirant compositions, since the solid particles readily clog small valve orifices. If a coarse liquid spray with large droplets is formed, there is excessive drip at the nozzle, and the material can even be squirted out in the form of a liquid stream, which rapidly runs off the surface on which it is deposited.

Much effort has accordingly been directed to the design of valves and valve delivery ports, nozzles or orifices which are capable of delivering finely divided sprays, of which U.S. Pat. Nos. 3,083,917 and 3,083,918, patented Apr. 2, 1963, to Abplanalp et al., and 3,544,258, dated Dec. 1, 1970, to Presant et al., are exemplary. The latter patent describes a type of valve which is now rather common, giving a finely atomized spray, and having a vapor tap, which indicates a mixing chamber provided with separate openings for the vapor phase and the liquid phase to be dispensed into the chamber, in combination with a valve actuator or button of the mechanical breakup type. Such valves provide a soft spray with a swirling motion. Another design of other valves of this type is described in U.S. Pat. No. 2,767,023. Valves with vapor taps are generally used where the spray is to be applied directly to the skin, since the spray is less cold.

These types of valves are effective in providing fine sprays. However, they require high proportions of propellant. If a vapor tap is provided, the valve tends to consume a larger than normal amount of propellant gas, because more propellant gas is vented with each squirt. Such valves therefore require aerosol compositions having a rather high proportion of propellant. This is a problem today, partially because the fluorocarbon propellants, which are widely favored, are thought to be deleterious, in that they are believed to accumulate in the stratosphere, where they may possibly interfere with the protective ozone layer there. Moreover, they have become rather expensive.

Another problem with such valves is that since they deliver a liquid mixture, and have valve passages in which a residue of liquid remains following the squirt, evaporation of the liquid in the valve may lead to deposition of solid materials, and valve clogging. This problem has given rise to a number of expedients to prevent the deposition of solid materials in a form which can result in clogging.

It has long been the practice to employ large amounts of liquefied propellant, say 50% by weight or more, in aerosol compositions, to obtain fine droplets of liquid sprays or fine powder sprays. These fine sprays result from the violent boiling of the liquefied propellant after it has left the container. A case in point is exemplified by the dispersion-type aerosol antiperspirants which contain 5% or so of astringent powder dispersed in liquefied propellant. It has not been possible to use substantially higher concentrations of astringents without encountering severe clogging problems.

There is considerable current interest in the use of compressed gases as propellants to obtain fine aerosol sprays. The reasons for the interest include the low cost of compressed gases, the flammability of liquefied hydrocarbon propellants, and the theorized hazard to the ozone layer of liquefied fluorocarbon propellants. Reasonably fine sprays of alcoholic solutions have been obtained using carbon dioxide at 90 psig and valving systems with very fine orifices. These orifices are so small that dispersed solids cannot be tolerated and even inadvertent contamination with dust will cause clogging. Thus, a typical system will employ a 0.014 inch capillary dip tube, a 0.010 inch valve stem orifice, and a 0.008 inch orifice in a mechanical break-up actuator button. Only limited variations in delivery rates are possible, since the use of significantly larger orifices will coarsen the spray droplets.

Thus far, the art has not succeeded in obtaining fine aerosol sprays using aqueous solutions with compressed gases. The reasons for this are that water has a higher surface tension and a higher viscosity than alcohol (ethanol or isopropanol) and is also a poorer solvent for the compressed gases, particularly carbon dioxide, which is preferred. All of these factors adversely affect the break-up of droplets to form a fine spray.

Special designs of the delivery port and valve passages have been proposed, to prevent the deposit of solid materials in a manner such that clogging can result. U.S. Pat. No. 3,544,258 provides a structure which is especially designed to avoid this difficulty, for example. Such designs result however in a container and valve system which is rather expensive to produce, complicated to assemble because of the numerous parts, and more prone to failure because of its complexity.

In accordance with the instant invention, it has been determined that less propellant is required to obtain a fine spray if, prior to delivery of a liquid aerosol composition to the valve of an aerosol container, one foams the aerosol composition. Conventional aerosol containers rely on a combination of small orifices in the valve and the rapid boiling of a high proportion of propellant to break up the liquid stream of aerosol composition into fine droplets. In accordance with the instant invention, fine droplets are formed from foamed aerosol composition, and at least in part are formed upon collapse of thin foam cell wells into fine droplets. The propellant serves to foam the liquid within the container, forming a foamed aerosol composition, and propel both any foam and any droplets that form when the foam collapses from the container through the valve and delivery port.

With conventional aerosol containers, a substantial proportion of the propellant is in liquid form as the aerosol composition passes through the valve and delivery port. Propellant evaporates as the spray travels through the air, and it continues to evaporate after the spray has landed on a surface. The heat of vaporization is taken from the surface, and the spray consequently feels cold. This is wasteful of propellant, as is readily evidenced by the coldness of sprays from conventional aerosol containers. In contrast, in the instant invention the propellant can be entirely in gaseous form when expelled with the liquid. The propellant is not wasted, therefore, and since there is substantially no liquid propellant to take up heat upon vaporization, the spray is not cold.

Numerous attempts have been made in the past to achieve fine sprays using compressed gases. These have been completely unsuccessful. Only coarse sprays and foams were obtained. In accordance with the invention, fine sprays are readily obtained, with the propellant in gaseous form.

In the instant invention, the aerosol composition emerging from the delivery port of the aerosol container can be in the form of a foam, or of a liquid, or both foam or droplets of foam and droplets of liquid. Reference to "foamed aerosol composition" will accordingly be understood to include both foams and liquids and mixed foams and liquids. To expel droplets of foam requires a liquid that readily produces small, stable foam bubbles. If the foam bubbles are sufficiently small, they can pass through the valve orifices without breaking. Also, larger bubbles may collapse, and re-form as small bubbles. To deliver a foam rather than droplets of collapsed foam, a valve with large orifices is used as with conventional aerosol containers.

Further in accordance with the invention, the rate of delivery of aerosol composition from the delivery port can be determined and limited by the size and number of orifices or pores across the line of flow of aerosol composition to the delivery port. This permits the use of simple valves with large openings. Since the flow restrictions (the orifices or pores) are in contact with liquid, rather than with air-dried solid residues, the likelihood of clogging is practically zero.

The aerosol containers in accordance with the invention accordingly foam an aerosol composition therein prior to expulsion from the container, and then expel the resulting foamed aerosol composition. These aerosol containers comprise, in combination, a pressurizable container having a valve movable between open and closed positions, with a valve stem, and a foam-conveying passage therethrough, in flow connection with a delivery port; bias means for holding the valve in a closed position; and means for manipulating the valve against the bias means to an open position for expulsion via the valve passage and delivery port of aerosol composition foamed within the container; means defining at least two separate compartments in the container, of which a first compartment has a volume of at least 0.5 cc and is in direct flow connection with the valve passage, and a second compartment is in flow connection with the valve passage only via the first compartment; at least one first liquid tap orifice having a diameter within the range from about 0.012 to about 0.2 cm and communicating the first and another compartment for flow of liquid aerosol composition into the first compartment from the other compartment, and of sufficiently small dimensions to restrict flow of liquid aerosol composition therethrough; the ratio of first compartment volume/first orifice diameter being from about $10/x$ and preferably from about $20/x$ to about $400/x$, and preferably about $200/x$, where $x$ is 1 when the orifice length is less than 1 cm, and 2 when the orifice length is 1 cm or more; at least one second gas tap orifice having a total cross-sectional open area within the range from about $4 \times 10^{-5}$ to about $1.3 \times 10^{-2}$ cm$^2$ (a single orifice having a diameter within the range from about 0.007 to about 0.13 cm) and communicating the first and second compartments for flow of propellant gas into the first compartment from the second compartment therethrough, and of sufficiently small dimensions to restrict flow of propellant gas and form bubbles of such gas in liquid aerosol composition across the line of flow thereof to the valve, thereby to foam the aerosol composition upon opening of the valve to atmospheric pressure, and to expel foamed aerosol composition through the open valve.

Preferred embodiments of the aerosol containers in accordance with the invention are illustrated in the drawings, in which:

FIG. 3 represents a longitudinal sectional view of another embodiment of aerosol container in accordance with the invention, in which one liquid tap and one gas tap orifice are provided, the liquid tap orifice being a capillary dip tube, in a container with three compartments; and FIG. 4 represents a cross-sectional view taken along the line 4—4 of FIG. 3.

Figure 1:
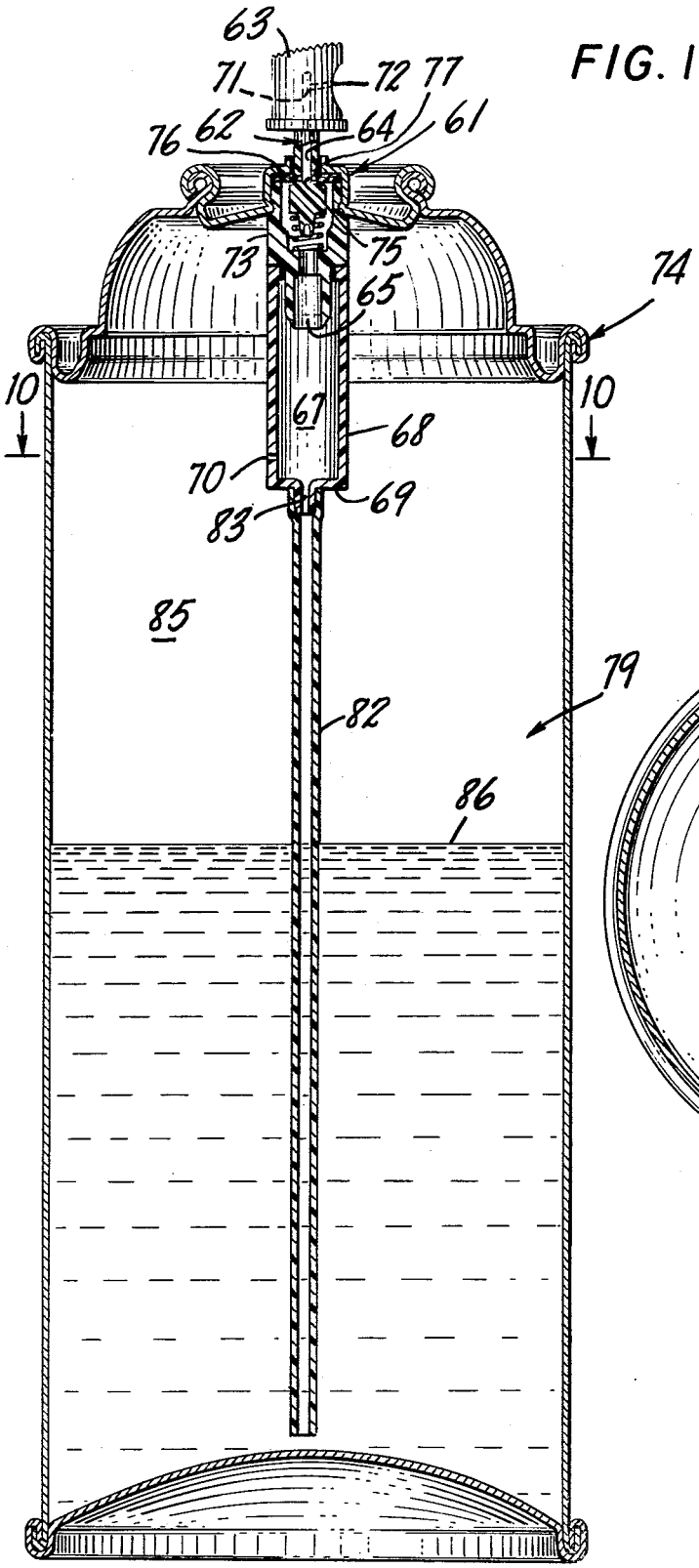
FIG. 1 represents a longitudinal sectional view of an embodiment of aerosol container in accordance with the invention, in which one liquid tap and one gas tap orifice are provided in a container with two compartments.

In principle, the aerosol containers of the invention utilize a container having at least two compartments, a first foam compartment and a second propellant gas compartment, communicated by at least one gas tap orifice, which is across the line of flow through the foam compartment to the valve delivery port from the propellant compartment. A liquid aerosol composition to be foamed and then expelled from the container is placed in another compartment of the container, in flow communication via a liquid tap orifice with the first foam compartment, so as to admit liquid aerosol composition into the first foam compartment across the line of propellant gas flow via the gas orifice or orifices to the valve. The liquid aerosol composition to be dispensed can be in the second compartment, dissolved or emulsified with liquid propellant or as a separate layer from the propellant layer, or in a third compartment, and the propellant is placed in the second or propellant compartment on the other side of the gas tap orifice or orifices. When the valve is opened, the propellant passes in gaseous form through the gas tap orifice(s) and foams the liquid aerosol composition in the foam compartment, at the same time propelling the foamed aerosol composition to and through the open valve passage out from the container.

The first or foam compartment between the gas tap and liquid tap orifices and the valve provides the space needed for foam formation, and has a volume of at least 0.5 cc and preferably from 1 to 4 cc, but larger compartments can be used. A practical upper limit based on the available aerosol container sizes is about 20 cc, but this can of course be exceeded since it is limited only by the size of the aerosol container. In general, the required volume of the first or foam compartment depends upon the rate at which product is delivered. Low delivery rates (less than about 0.2 g per second) require a capacity of about 0.5 to 1 cc. Medium delivery rates (about 0.2 to 0.5 g per second) require a capacity of about 1 to 2 cc. High delivery rates (about 0.5 to 2 g per second) require a capacity of about 2 to 4 cc. The first compartment may have a higher capacity, but it should preferably not have a smaller capacity; otherwise the space available may not be sufficient for foaming. These required volumes are illustrative and not limiting.

The length of the foam compartment, i.e., the distance from the nearest gap tap orifice(s) to the inlet end of the valve passage, is determined by the foam characteristics of the composition and whether it is desired to dispense a foam or a liquid or a mixture of the two. Consequently, the length of the foam compartment is not critical, but can be adjusted according to these requirements.

The overall dimensions of the gas tap and the liquid tap orifice(s) are selected according to the required product delivery rate (including propellant expelled) and whether a liquefied propellant or a compressed gas propellant is used. Where a compressed gas propellant is the only propellant present in the container, the quantity of propellant is quite limited and must be conserved by using only small gas tap orifices.

The following illustrates the orifice sizes that are used and is not intended to be limiting:

Using a compressed gas propellant to obtain a high product delivery rate, a 0.0076 to 0.10 cm i.d. > 1 cm long capillary dip tube could be used as the liquid tap orifice and a 0.007 to 0.010 cm i.d. short < 1 cm orifice (as in a compartment wall) as the gas tap orifice.

Using a compressed gas propellant to obtain a low product delivery rate, a 0.035 to 0.050 cm i.d. > 1 cm long capillary dip tube could be used as the liquid tap orifice and a 0.015 cm i.d. short < 1 cm orifice as the gas tap orifice.

Using a liquefied propellant to obtain a high product delivery rate, a 0.15 to 0.20 cm i.d. > 1 cm capillary dip tube could be used as the liquid tap orifice and a 0.025 to 0.033 cm i.d. < 1 cm orifice as the gas tap orifice.

Using a liquefied propellant to obtain a low product delivery rate, a 0.076 cm i.d> 1 cm capillary dip tube could be used as the liquid tap orifice and a 0.046 cm i.d. < 1 cm orifice as the gas tap orifice.

In general, a <1 cm orifice of about half the diameter can be substituted for the > 1 cm capillary dip tube used as the liquid tap orifice. Conversely, a > 1 cm capillary tube of about twice the diameter can be substituted for the < 1 cm orifice used as the gas tap orifice.

The gas tap orifice (or orifices) should have (or total) a total cross-sectional open area within the range from about $4 \times 10^{-5}$ to about $1.3 \times 10^{-2}$ cm$^2$ (a single orifice having an internal diameter within the range from about 0.007 to about 0.13 cm) and can be larger or smaller than the liquid tap orifice (or orifices).

The liquid tap orifice can be short (i.e., < 1 cm) or long (i.e., > 1cm). A long orifice must have a larger diameter than a small one, because of liquid friction during the passage therethrough. Thus a capillary dip tube can have an internal diameter within the range from about 0.025 cm to about 0.2 cm, while a short < 1 cm orifice can have an internal diameter within the range from about 0.12 to about 0.1 cm. To provide sufficient foaming space, there is an important ratio of foam compartment volume to liquid tap orifice diameter that should be from about $10/x$, and preferably from about $20/x$, up to about $400/x$, preferably about $200/x$, where $x$ is a constant selected according to orifice length. For orifices less than 1 cm long, $x = 1$. For orifices 1 cm long or greater, $x = 2$.

Preferred dimensions depend upon whether a liquid or gaseous propellant is used, and are as follows:

| | Liquid Propellant | Gas Propellant |
|---|---|---|
| First Compartment volume (cc) | 0.5 to 4 | 1 to 4 |
| First Liquid Tap Orifice[1] inside diameter (cm) | 0.06 to 0.2 | 0.012 to 0.1 |
| Ratio of First Compartment Volume to First Liquid Tap Orifice Diameter | $\frac{10}{x}$ to $\frac{50}{x}$ | $\frac{20}{x}$ to $\frac{100}{x}$ |
| Second Gas Tap Orifice[2] Cross-sectional area (cm$^2$) | $1.6 \times 10^{-3}$ $1.3 \times 10^{-2}$ | $4 \times 10^{-5}$ $1.3 \times 10^{-4}$ |

[1]These dimensions are for a long orifice (capillary dip tube). If the orifice is short, less than 1 cm, diameters are reduced by ½.
[2]Values shown are for a short orifice, less than 1 cm.

Both the gas tap and liquid tap orifices are in the means defining the foam compartment, such as a wall thereof. The liquid tap orifice is placed so that liquid aerosol composition entering the foam compartment is disposed across the line of flow from the gas tap orifice to the valve and out from the container. The liquid tap orifice can be below, above, or on a line with the gas tap orifice.

The gas tap orifice(s) should be located out of direct contact with propellant liquid to ensure that the propellant gas, whether liquefied or not, enters as gas bubbles into the liquid aerosol composition to form a foam. The type of foam that is formed depends upon a number of variables, of which the most important are the foaming qualities of the liquid aerosol composition; the diameter of the gas tap orifice(s) which determines the size of the gas bubbles released therefrom into the liquid aerosol composition; the height or depth of the layer of aerosol composition through which the bubbles must pass in order to reach the valve for expulsion from the container; the distance between the layer of aerosol composition and the valve; and the rate of formation, i.e., rate of bubbling, and relative stability of the foam, which can be controlled by pressure of propellant gas; the number of gas tap orifices; and foaming agents present in the liquid aerosol composition.

The formation of a foam is a highly dynamic process. When the foam is first formed, the walls of the foam bubbles (which are of liquid aerosol composition) are relatively thick. As the foam ages, liquid drains from the bubble walls, the walls become thinner, and eventually collapse. Since liquid drains from the top to the bottom of a compartment of foam, the bubble walls at the top of the foamed aerosol composition in the compartment are thinner than they are at the bottom. It is the top portion of the foamed aerosol composition that passes through the valve orifice in the aerosol containers of the invention, when the containers are held with the valve up. If the containers are held with the valve down, the reverse is true.

While the aerosol container valve is open, gas bubbles continuously pass through the gas tap orifice(s) and enter the aerosol composition, to form a foam. At the same time, liquid drains from the foam as the foam progresses upwards, with the valve stem at the top, and the foam bubble walls start to break.

It will be apparent that if relatively large gas bubbles are passed slowly through a layer of aerosol liquid located relatively far from the valve, the foam must rise a considerable distance before reaching the valve, and if the foam drains rapidly and is unstable, the foam may collapse before it reaches the valve, and only gas will be expelled. This of course is undesirable.

At the other extreme, if the foam is formed rapidly, with small gas bubbles, the distance the foam must rise to reach the valve is short, and the foam is stable, and drains slowly, the resulting foam emerging from the valve will be relatively wet, and the droplet size relatively large. This could be acceptable, but in most cases the optimum is a condition somewhere between these two extremes and the length and diameter of the foam compartment, the diameter and number of the gas tap and liquid tap orifices, the viscosity of the aerosol composition, and other variables are adjusted (usually by trial and error) to correct dimensions for the container, the compartments therein, and the orifices to give the type of foam spray desired.

In general, with selection of the variables, satisfactory sprays can be obtained with aerosol compositions that form stable foams, unstable foams, and foams of intermediate stability. If the foam is unstable, the layer of aerosol liquid should be close to the valve, and the gas tap orifice(s) should be rather small, so that the liquid is foamed rapidly, with a plurality of small gas bubbles. A foam formed from small bubbles is more stable than one formed from large bubbles. If the required distance for foam to rise to reach the valve is short, the foam will reach the orifice of the valve and be expelled before the foam collapses.

On the other hand, if the liquid aerosol tends to give a stable foam, and a wet spray, it may be foamed with large gas bubbles, using relatively large gas tap orifices, which reduces the stability of the foam, and the distance of travel of the foam to the valve may be increased, using a longer container or a longer aerosol liquid composition compartment.

If only a small amount of aerosol liquid is available at a time to be foamed by a relatively large amount of gas, the foam will be relatively dry, and the resulting spray will be composed of small liquid droplets.

The foaming characteristics of the aerosol composition can be further modified by incorporating foam stabilizers, or defoamers, according to the relative foaming capability of the composition, and in addition its viscosity can be adjusted. More viscous compositions tend to form more stable foams than compositions of low viscosity.

The particular form of aerosol liquid is not critical. The aerosol containers of the invention can foam aqueous aerosols, organic solvent solution aerosols, and emulsions, both of water-in-oil and oil-in-water type.

The stability of the foam is reduced when the propellant is soluble in the liquid aerosol composition. Also, the greater the solubility of the propellant in the aerosol composition, the lower the efficiency of propellant utilization, since more of the propellant remains dissolved, and less is available for foaming the aerosol liquid within the container. Accordingly, it is generally preferred that the solubility of the propellant be at a minimum, and additions to the aerosol composition can be made to reduce solubility of the propellant therein. For instance, if the aerosol composition is an alcohol formulation, or employs any other water-soluble organic solvent, water may be added or the amount of water can be increased, so as to reduce the solubility of fluorocarbon and hydrocarbon propellants in the resulting solution. If the aerosol composition is an aqueous formulation, less soluble propellants, such as nitrogen, fluorocarbon and hydrocarbon propellants, are preferred over the more soluble propellants, such as carbon dioxide, nitrous oxide, or dimethyl ether.

The aerosol containers in accordance with the invention can be made of metal or plastic, the latter being preferred for corrosion resistance. However, plastic-coated metal containers can also be used, to reduce corrosion. Aluminum, anodized aluminum, coated aluminum, zincplated and cadmium-plated steel, tin and acetal polymers such as Celcon or Delrin are suitable container materials.

The gas tap and liquid tap orifices can be disposed in any type of porous or foraminous structure. One each of a gas tap and liquid tap orifice through the compartment wall separating the propellant and any other compartments from the foam compartment will suffice. A plurality of gas tap and liquid tap orifices can be used, for more rapid foaming and composition delivery. The total orifice open area is of course determinative, so that several large orifices can afford a similar delivery rate to many small orifices. However, gas tap orifice size also affects bubble size, as noted above, so that if samll bubbles are desired a plurality of small gas tap orifices may be preferable to several large orifices.

Orifices may also be provided on a member inserted in the wall or at one end of the wall separating the propellant and any other compartments from the foam compartment. One type of such member is a perforated or apertured plastic or metal plate or sheet.

The liquid tap orifice can be rather short or rather long, as in a capillary dip tube extending into the bottom of a layer or compartment for liquid aerosol composition. The term "orifice" as used herein generally encompasses capillary passages, which behave as orifices regardless of length in respect to liquid aerosol composition flow therethrough.

The cross-sectional shape of the orifice is not critical. The orifices can be circular, elliptical, rectangular, polygonal, or any other irregular or regular shape in cross-section.

Large orifices form large bubbles, and expel a relatively high ratio of propellant to liquid, and these are less efficient utilizers of propellant. Very small orifices may offer high resistance to gas flow, unless they are relatively short, i.e., the material is thin, as in the case of membrane filters. Since thin materials are relatively weak, supporting structures may be required, which increase the cost of the container. The preferred orifices are through the separating compartment wall.

The gas tap and liquid tap orifices should provide an open area sufficient to provide a propellant gas flow to foam a sufficient volume of liquid aerosol composition for a given delivery of foam spray. Thus, the open area is determined by the amount of aerosol composition to be foamed, and the amount of the delivery. In general, the orifice open area is not critical, and can be widely varied. However, it is usually preferred that the open area be within the range from about 0.005 to about 10 $mm^2$, and still more preferably from about 0.01 to about 1 $mm^2$.

Figure 2:
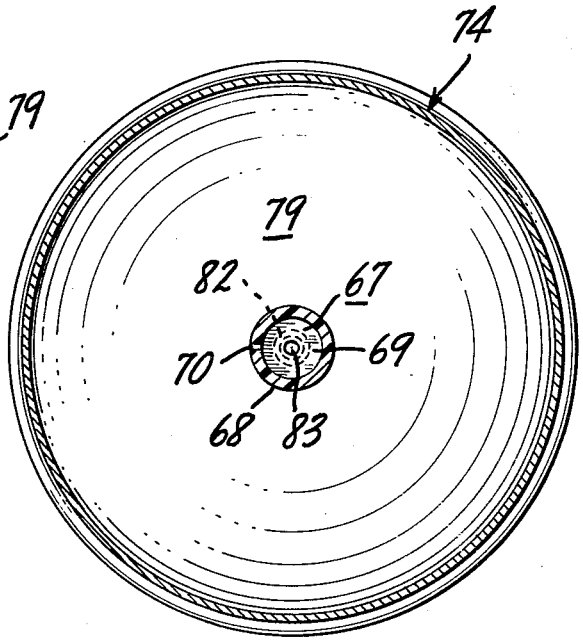
FIG. 2 represents a cross-sectional view taken along the line 2—2 of FIG. 1.

In the aerosol container shown in FIGS. 1 and 2, the aerosol valve 10 is of conventional type, with a valve stem 11 having a valve button 12 attached at one end and a flow passage 13 therethrough, in flow communication at one end via port 15 with the interior of a first foam compartment 20 of the container 1, defined by side walls 21, with a gas tap orifice 2 therein, and an orifice plate bottom 22 with a liquid tap orifice 3 therein. The orifice 2 is 0.01 inch in diameter, and orifice 3 is 0.015 inch in diameter. Both orifices 2,3 are in flow communication with a second compartment 30, defined by side walls 21 and the outer container wall 4. The valve passage 13 is open at the other end at port 14 via button passage 16 to delivery orifice 17. The valve button 12 is manually moved against the coil spring 18 between open and closed positions. In the closed position, shown in FIG. 1, the valve port 14 is closed, the valve being seated against the valve seat. In the open position, the valve stem is depressed by pushing in button 12, so that port 14 is exposed, and the contents of the foam compartment are free to pass through the valve passage 13 and button passage 16 out the delivery orifice 17.

The remainder of the interior of the aerosol container outside the walls 21 and bottom 22 of the foam compartment 20 thus constitutes the second annular propellant compartment 30 surrounding the first. The second compartment 30 contains propellant, which is a propellant gas (but which can be a liquefied propellant, such as a hydrocarbon or fluorocarbon), which fills head space 35 over the layer 36 of aerosol composition. A dip tube 32 extends from the orifice 3 in foam compartment 20 to the bottom of the container in the propellant compartment 30. Through it, liquid aerosol composition enters the foam compartment at orifice 3, when the valve 10 is opened, and forms a layer therein.

In operation, button 12 is depressed, so that the valve is manipulated to the open position. Liquid aerosol composition is drawn up via dip tube 32 and orifice 3 into foam compartment 20, while propellant gas passes through the orifice 2 and bubbles into aerosol composition in the compartment 20, where it foams the aerosol composition, and then expels the foamed aerosol composition through the passages 13, 16 leaving the container via orifice 17 of the valve as a fine spray.

In this embodiment, aerosol composition and propellant gas are simultaneously introduced into the foam compartment 20 when the button 12 is depressed. The characteristics of the spray that is dispensed depends on the relative rates at which these components are introduced into the foam compartment. Thus, if the proportion of propellant gas to aerosol composition is relatively high, the spray will be moist rather than wet, and the delivery rate will be low. If the proportion of propellant gas to aerosol composition is relatively low, the spray will be wet, and the delivery rate will be relatively high.

In the aerosol container shown in FIGS. 3 and 4, the liquid aerosol composition is stored in a separate aerosol composition compartment 56. The aerosol valve 41 is of conventional type, as shown in FIG. 1, with a valve stem 42 having a valve button 43 attached at one end, with valve button passage 44 and delivery orifice 54 therethrough, and a valve body 46 bonded at 47 to the wall 58 of the first foam compartment 50 of the container, with flow passages 54, 55 therethrough, as best seen in FIG. 1. Passage 55 opens to the interior of the foam compartment 50, defined by side walls 58 and bottom 59, with a single gas tap orifice 48, 0.005 inch in diameter, through the valve and button passages 54, 55, 44 out the delivery orifice 45.

The foam compartment 50 is in communication via orifice and capillary dip tube 57 with an aerosol compartment 56 therebelow, in which aerosol composition is stored. The dip tube 57 extends to the bottom of the compartment 56.

Aerosol composition is drawn up the dip tube 57 upon opening the valve by pushing in valve button 43.

Surrounding the aerosol compartment 56, and in fact in the remainder of the interior of the aerosol container, outside the walls 58 and bottom 59 of the foam compartment 50, is propellant compartment 60. The propellant compartment contains gaseous propellant, but a liquefied propellant, such as a hydrocarbon or fluorocarbon, can also be used.

The compartment 56 is made of resilient plastic material 51 such as polyethylene or polypropylene sheet, so that the wall collapses as the aerosol composition is expelled under pressure of propellant gas in propellant compartment 60 externally of the compartment 56.

In operation, button 43 is depressed, so that the valve is manipulated to the open position. Aerosol composition is drawn up via capillary dip tube 57 into foam compartment 50, while propellant gas passes through the gas tap orifice 48 and bubbles into aerosol composition in the compartment 50, where it foams the aerosol composition, and then expels the foamed aerosol composition through the passages 54, 55, 44 leaving the container via orifice 45 of the valve as a fine liquid spray.

The third compartment 56 is advantageous when the aerosol composition is corrosive, and contact with a metallic container is to be avoided. It is also advantageous to keep the aerosol composition and propellant separate, if the propellant is a liquefied propellant, and forms an emulsion with the aerosol composition. If an emulsion is formed, propellant in liquid form is expelled with the foamed aerosol composition, which is wasteful of propellant and also produces a cold spray.

Moreover, in the event that the volume of aerosol composition is small, relative to the volume of the outer container (which will often be the case if a very low delivery rate is required), a narrow third compartment confines the aerosol composition in a manner to ensure delivery of all of the aerosol composition in the container.

The third compartment preferably is of flexible plastic material so that a relatively constant pressure is maintained on the aerosol composition, to force it up the dip tube when the valve is opened. However, the third compartment can also be fabricated from a rigid plastic material or metal. Any material can be used as the walls of the third compartment that is inert or not adversely affected by the aerosol composition or propellant. When of rigid material, the pressure in the compartment is the same as that in the propellant compartment, when the valve is closed, since propellant gas can enter the head space in the third compartment by way of the orifice and the dip tube. When the valve is opened, the aerosol composition in the third compartment rises in the dip tube against a lowered pressure in the head space thereabove. This can retard or restrict delivery if a relatively large amount of aerosol composition is to be expelled at one time, and to avoid this, an orifice can be placed at the top of the third compartment, open to the propellant compartment above the level of the aerosol composition. The wall of the third compartment can be in flow communication with the propellant compartment, and even permeable to propellant gas.

The aerosol containers and the process of the instant invention can be used to deliver any aerosol composition in the form of a spray. It is particularly suited for use with aqueous solutions, since these are readily compounded to produce a foam. However, any liquid aerosol composition can be foamed, and the container can be used for any liquid aerosol composition. The range of products that can be dispensed by this aerosol container is diverse, and includes pharmaceuticals for spraying directly into oral, nasal and vaginal passages; antiperspirants; hair sprays, fragrances and flavors; body oils; insecticides; window cleaners and other cleaners; spray starches; and polishes for autos, furniture and shoes.

Another advantageous feature is that smaller amounts of liquefied fluorocarbon propellant can be used to obtain the same quality of spray, as compared with conventional aerosol containers, resulting in an economy.

Having regard to the foregoing disclosure, the following is claimed as inventive and patentable embodiments thereof:

1. An aerosol container for foaming an aerosol composition therein prior to expulsion from the container, and then expelling the resulting foam, comprising, in combination, a pressurizable container having a valve movable between open and closed positions, with a valve stem, a foam-conveying passage therethrough and a delivery port in flow connection therewith; bias means for holding the valve in a closed position; and means for manipulating the valve against the bias means to an open position, for expulsion of aerosol foamed composition within the container via the valve passage and delivery port; means defining at least two separate compartments in the container, of which a first compartment has a volume of at least 0.5 cc and is in direct flow connection with the valve passage, and a second compartment is in flow connection with the valve passage only via the first compartment; at least one first liquid tap orifice having a diameter within the range from about 0.012 to about 0.2 cm and communicating the first and another compartment for flow of liquid aerosol composition into the first compartment from the other compartment, and of sufficiently small dimensions to restrict flow of liquid aerosol composition therethrough; the ratio of first compartment volume/first orifice diameter being from about $10/x$ to about $400/x$, where $x$ is 1 when the orifice length is less than 1 cm, and 2 when the orifice length is 1 cm or more; at least one second gas tap orifice having a total cross-sectional open area within the range from about $4 \times 10^{-5}$ to about $1.3 \times 10^{-2}$ cm$^2$ and communicating the first and second compartments for flow of propellant into the first compartment from the second compartment therethrough, and of sufficiently small dimensions to restrict flow of propellant gas and form bubbles of such gas in liquid aerosol composition across the line of flow thereof to the valve, thereby to foam the aerosol composition upon opening of the valve to atmospheric pressure, and to expel foamed aerosol composition through the open valve.

2. An aerosol container according to claim 1, in which the first compartment has a volume of from about 1 to about 4 cc.

3. An aerosol container according to claim 2, having a single second gas tap orifice having a diameter within the range from about 0.007 to about 0.13 cm.

4. An aerosol container according to claim 1, having a capillary dip tube as the liquid tap orifice.

5. An aerosol container according to claim 1, having an orifice in a wall of the foam compartment as the liquid tap orifice.

6. An aerosol container according to claim 1, in which the container is cylindrical, with the valve at one end, and the means defining the first compartment comprises a concentric inner cylinder spaced from the walls of the container surrounding and extending from the valve, the gas tap orifice is through a wall of the inner cylinder, the liquid tap orifice is through a wall of the inner cylinder, and the remainder of the interior of the aerosol container outside the walls and bottom of the inner cylinder comprises the second annular compartment.

7. An aerosol container according to claim 6, having a plurality of gas tap orifices through a side wall of the inner cylinder.

8. An aerosol container according to claim 6, comprising a third compartment for liquid aerosol composition from the second compartment and in direct flow connection with the first separate compartment via the liquid tap orifice.

9. An aerosol container according to claim 8, comprising a capillary dip tube as the liquid tap orifice.

10. An aerosol container according to claim 1, in which the container is cylindrical, with the valve at one end, and the means defining the first compartment comprises a concentric inner cylinder spaced from the walls of the container surrounding and extending from the valve, the gas tap orifice is through a wall of the inner cylinder, a third compartment for liquid aerosol composition in direct fluid flow connection with the first compartment via the liquid tap orifice, and disposed below and concentric with the inner cylinder, and the remainder of the interior of the aerosol container outside the walls and bottom of the inner cylinder and third compartment comprises the second annular compartment.

11. An aerosol container according to claim 10, in which the walls of the third compartment are of resilient plastic sheet material and can collapse as liquid aerosol composition is withdrawn therefrom under pressure of propellant in the second compartment.

* * * * *

UNITED STATES PATENT OFFICE
CERTIFICATE OF CORRECTION

Patent No. 4,019,657 Dated April 26, 1977

Inventor(s) J. George Spitzer, et al

It is certified that error appears in the above-identified patent and that said Letters Patent are hereby corrected as shown below:

Column 5, line 36, "0.0076" should be --0.076--.

Column 6, line 16, the Table should appear as shown below:

| | Liquid Propellant | Gas Propellant |
|---|---|---|
| First Compartment volume (cc) | 0.5 to 4 | 1 to 4 |
| First Liquid Tap Orifice[1] inside diameter (cm) | 0.06 to 0.2 | 0.012 to 0.1 |
| Ratio of First Compartment Volume to First Liquid Tap Orifice Diameter | $\frac{10}{x}$ to $\frac{50}{x}$ | $\frac{20}{x}$ to $\frac{100}{x}$ |
| Second Gas Tap Orifice[2] Cross-sectional area ($cm^2$) | $1.6 \times 10^{-3}$ $1.3 \times 10^{-2}$ | $4 \times 10^{-5}$ $1.3 \times 10^{-4}$ |

[1]These dimensions are for a long orifice (capillary dip tube). If the orifice is short, less than 1 cm, diameters are reduced by ½.
[2]Values shown are for a short orifice, less than 1 cm.

Column 8, line 35, "samll" should be --small--.

Column 8, line 45, "generally" should be --generically--.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*